US010548406B2

(12) United States Patent
Garland

(10) Patent No.: US 10,548,406 B2
(45) **Date of Patent: *Feb. 4, 2020**

(54) ARTICULATED SOFA BED WITH LOCKING MECHANISM

(71) Applicant: American Leather Operations, LLC, Dallas, TX (US)

(72) Inventor: Thomas A. Garland, Palmetto, FL (US)

(73) Assignee: American Leather Operations, LLC, Dallas, TX (US)

( * ) Notice: Subject to any disclaimer, the term of this patent is extended or adjusted under 35 U.S.C. 154(b) by 225 days.

This patent is subject to a terminal disclaimer.

(21) Appl. No.: 15/259,355

(22) Filed: Sep. 8, 2016

(65) Prior Publication Data

US 2016/0374477 A1 Dec. 29, 2016

Related U.S. Application Data

(63) Continuation of application No. 14/052,186, filed on Oct. 11, 2013, now Pat. No. 9,468,303.

(51) Int. Cl.
*A47C 17/16* (2006.01)
*A47C 17/165* (2006.01)
(Continued)

(52) U.S. Cl.
CPC ..... *A47C 17/16* (2013.01); *A47C 17/04* (2013.01); *A47C 17/132* (2013.01);
(Continued)

(58) Field of Classification Search
CPC ..... A47C 17/04; A47C 17/132; A47C 17/134; A47C 17/16; A47C 17/165; A47C 17/17;
(Continued)

(56) References Cited

U.S. PATENT DOCUMENTS 2,007,988 A * 7/1935 Thomas ..... A47C 17/23 5/12.1
2,570,401 A 10/1951 Stein
(Continued)

FOREIGN PATENT DOCUMENTS

CA 953053 8/1974
CN 2043842 9/1989
(Continued)

OTHER PUBLICATIONS

Cover of HighPoints publication, Tiffany Sleeper, Market Introductions, Apr. 2000, 1 pg.
(Continued)

*Primary Examiner* — David R Hare
(74) *Attorney, Agent, or Firm* — Womble Bond Dickinson (US) LLP

(57) ABSTRACT

A seat convertible to a bed. The seat includes a locking mechanism for fixably maintaining a head panel section of the bed in a generally horizontal orientation when the bed is in the deployed configuration and releasing the head panel section from the deployed configuration by a lifting motion. The locking mechanism is connected to the head panel section and a mid-swinging member. The mid-swinging member pivotally attaches to the head panel section and a stationary mounting arm. The stationary mounting arm is fixably attached to a seat frame.

13 Claims, 13 Drawing Sheets

(51) Int. Cl.

| | |
|---|---|
| ***A47C 17/175*** | (2006.01) |
| ***A47C 17/13*** | (2006.01) |
| ***A47C 17/86*** | (2006.01) |
| ***A47C 17/04*** | (2006.01) |
| ***A47C 17/207*** | (2006.01) |

(52) U.S. Cl.
CPC ..... *A47C 17/134* (2013.01); *A47C 17/165* (2013.01); *A47C 17/1756* (2013.01); *A47C 17/2076* (2013.01); *A47C 17/86* (2013.01)

(58) Field of Classification Search
CPC ..... A47C 17/175; A47C 17/1756; A47C 17/2076; A47C 17/86
See application file for complete search history.

(56) References Cited

U.S. PATENT DOCUMENTS

| | | | | | |
|---|---|---|---|---|---|
| 2,664,145 | A * | 12/1953 | Creveling | A47C 17/23 | 297/109 |
| 2,671,228 | A | 3/1954 | De Maria | | |
| 2,740,131 | A * | 4/1956 | Vogel | A47C 17/2076 | 5/309 |
| 2,785,415 | A | 3/1957 | Petersen | | |
| 2,841,800 | A * | 7/1958 | Thomas | A47C 17/23 | 5/13 |
| 2,876,461 | A | 3/1959 | Bontempi | | |
| 3,085,257 | A | 4/1963 | Laemmle | | |
| 3,104,913 | A | 9/1963 | Faulkner et al. | | |
| 3,107,363 | A * | 10/1963 | Simmons | A47C 17/1756 | 5/41 |
| 3,145,049 | A | 8/1964 | Duke | | |
| 3,178,731 | A * | 4/1965 | Pokorny, Jr. | A47C 17/23 | 5/13 |
| 3,179,469 | A | 4/1965 | Heuston | | |
| 3,319,269 | A | 5/1967 | Maddox | | |
| 3,456,268 | A * | 7/1969 | Rogers, Jr. | A47C 17/22 | 5/13 |
| 3,506,984 | A | 4/1970 | Ellis, Jr. et al. | | |
| 3,508,283 | A * | 4/1970 | Dukellis | A47C 17/225 | 5/13 |
| 3,589,770 | A | 6/1971 | Kelley | | |
| 3,608,959 | A | 9/1971 | Sarvas | | |
| 3,695,690 | A | 10/1972 | Carson | | |
| 3,771,178 | A * | 11/1973 | Inman | A47C 17/23 | 5/13 |
| 3,844,612 | A | 10/1974 | Borggren et al. | | |
| 3,864,764 | A | 2/1975 | Janusc | | |
| 3,908,210 | A | 9/1975 | Alembik | | |
| 4,032,999 | A * | 7/1977 | Pringle | A47C 17/13 | 5/14 |
| 4,563,037 | A | 1/1986 | Tiffany | | |
| 4,694,514 | A | 9/1987 | Crossett | | |
| 4,737,996 | A | 4/1988 | Tiffany | | |
| D338,349 | S | 8/1993 | Warnock | | |
| 5,320,407 | A | 6/1994 | Tell | | |
| D360,311 | S | 7/1995 | Stamberg et al. | | |
| D367,566 | S | 3/1996 | Walters, III et al. | | |
| 5,626,388 | A | 5/1997 | Haltner | | |
| 5,681,090 | A | 10/1997 | St. Thomas | | |
| 5,826,939 | A | 10/1998 | Beyer | | |
| 5,855,030 | A * | 1/1999 | Williams | A47C 17/225 | 5/12.1 |
| 5,904,401 | A | 5/1999 | Alberda et al. | | |
| 6,089,657 | A | 7/2000 | Banno et al. | | |
| 6,116,685 | A | 9/2000 | White et al. | | |
| 6,293,624 | B1 | 9/2001 | Gaylord et al. | | |
| 6,709,054 | B2 | 3/2004 | Riley et al. | | |
| 6,796,609 | B2 | 9/2004 | Illulian | | |
| D501,331 | S | 2/2005 | Chen | | |
| 6,904,628 | B2 | 6/2005 | Murphy et al. | | |
| 7,040,700 | B2 | 5/2006 | Duncan et al. | | |
| D526,803 | S | 8/2006 | Lee | | |
| 7,373,675 | B2 * | 5/2008 | Thurow | A47C 17/1756 | 5/37.1 |
| 7,549,182 | B2 | 6/2009 | Murphy | | |
| 8,011,034 | B2 | 9/2011 | Hoffman et al. | | |
| 8,893,323 | B2 * | 11/2014 | Garland | A47C 17/2076 | 5/38 |
| 8,997,273 | B2 * | 4/2015 | Murphy | A47C 17/225 | 5/13 |
| 9,144,319 | B2 * | 9/2015 | Murphy | A47C 17/04 | |
| 9,314,104 | B2 * | 4/2016 | Stieglitz | A47C 7/506 | |
| 9,468,303 | B2 * | 10/2016 | Garland | A47C 17/04 | |
| 2003/0070225 | A1 * | 4/2003 | Murphy | A47C 17/1753 | 5/13 |
| 2007/0283491 | A1 * | 12/2007 | Murphy | A47C 17/20 | 5/13 |
| 2009/0235452 | A1 * | 9/2009 | Hoffman | A47C 17/2076 | 5/13 |
| 2011/0010846 | A1 * | 1/2011 | Murphy | A47C 3/16 | 5/2.1 |
| 2011/0010847 | A1 * | 1/2011 | Murphy | A47C 3/16 | 5/35 |
| 2011/0018331 | A1 * | 1/2011 | Murphy | A47C 1/0355 | 297/85 R |

FOREIGN PATENT DOCUMENTS

| | | |
|---|---|---|
| CN | 2060312 | 8/1990 |
| CN | 2222467 | 3/1996 |
| CN | 1271554 | 11/2000 |
| CN | 2860221 | 1/2007 |
| DE | 3513076 | 10/1986 |
| EP | 645108 | 3/1995 |
| GB | 2150021 | 6/1985 |
| JP | 5091464 | 7/1975 |
| WO | 1990015556 | 12/1990 |
| WO | 2013059309 | 4/2013 |

OTHER PUBLICATIONS

Cover of The Philadelphia Inquirer, Home and Design Section, Apr. 21, 2000, 1 pg.
Functional Upholstery Takes Center Stage, Furniture Today, vol. 24, No. 30d, Apr. 9, 2000, 2 pgs.
Home & Garden, Sun-Sentinel, p. 3E, South Florida, Apr. 14, 2000, 1 pg.
International Search Report and Written Opinion for PCT/US2013/64581, dated Mar. 25, 2014, 22 pgs.
International Search Report and Written Opinion of PCT/US12/60602, dated Jan. 4, 2013, 19 pgs.
Photograph 1, Version 1, sofa shown at trade show in San Francisco, folding center leg and Version 1 front leg actuator, Jan. 2000, 1 pg.
Photograph 10, Versions 1 and 2, inside arm sprint assist, Jan. 2000, 1 pg.
Photograph 11, Versions 1 and 2, inside arm spring assist, Jan. 2000, 1 pg.
Photograph 12, Versions 1 and 2, inside arm spring assist, Jan. 2000, 1 pg.
Photograph 2, Version 1, sofa shown at trade show in San Francisco, sofa partially opened, Jan. 2000, 1 pg.
Photograph 3, Version 1, sofa shown at trade show in San Francisco, sofa completely opened, Jan. 2000, 1 pg.
Photograph 4, Version 1, sofa shown at trade show in San Francisco, tube assembly front pivot offset and extended and folding center leg extended, Jan. 2000, 1 pg.
Photograph 5, Version 1, sofa shown at trade show in San Francisco, folding center leg extended and front wood leg with Version 1 of front leg actuator, Jan. 2000, 1 pg.
Photograph 6, Version 2, sofa shown at trade show in High Point, folding center leg extended and metal tube front leg with Version 2 of front leg actuator, Apr. 2000, 1 pg.
Photograph 7, Version 2, sofa shown at trade show in High Point, metal tube front leg with Version 2 of front leg actuator and folding center leg extended, Apr. 2000, 1 pg.

(56) References Cited

OTHER PUBLICATIONS

Photograph 8, Version 2, sofa shown at trade show in High Point, metal tube front leg with Version 2 of front leg actuator and folding center leg extended, Apr. 2000, 1 pg.
Photograph 9, Versions 1 and 2, tube assembly front pivot (offset & extended), Jan. 2000, 1 pg.
UDM Design News, p. 32, Jun. 2000, 1 pg.
English abstract of CN1271554, last viewed on Espacenet.com on Oct. 30, 2015, 1 pg.
English abstract of CN2043842, last viewed on Espacenet.com on Oct. 30, 2015, 1 pg.
English abstract of CN2222467, last viewed on Espacenet.com on Oct. 30, 2015, 1 pg.
English abstract of CN2060312, last viewed on Espacenet.com on Oct. 30, 2015, 1 pg.
Abstract of corresponding U.S. Pat. No. 3,868,733, to JPS5091464, last viewed on Espacenet.com on Oct. 30, 2015, 1 pg.
Chinese Office Action for App. No. 201380056381.9, dated Dec. 22, 2016, 21 pgs.

* cited by examiner

ARTICULATED SOFA BED WITH LOCKING MECHANISM

CROSS REFERENCE TO RELATED APPLICATION

This application is a continuation of U.S. application Ser. No. 14/052,186 filed Oct. 11, 2013. The content of this application is incorporated herein by reference in its entirety.

TECHNICAL FIELD

The present invention relates to furniture, and more particularly to a foldable articulated sofa bed.

BACKGROUND

A sofa bed can be converted between a bed configuration and a sofa configuration. One type of sofa beds has three bed sections with mattress portions integrally formed on each of the sections. The mattress portion should be of some thickness to be comfortable when laid upon as a bed section. Collectively, the three sections form the bed when the sofa bed is deployed. An articulating mechanism connects to the sections to guide their movements between the bed and sofa configuration. To this end, sofa beds are bulky compared to contemporary sofa counterparts due to having to stow the multiple bed sections and the articulating mechanism. Additionally, contemporary sofas can be designed with more aesthetic consideration than existing sofa beds as they are not constrained in also having to function as an articulating bed.

The prior art includes a range of designs of such sofa beds. U.S. Pat. No. 2,740,131, for example, discloses a sofa bed where the back section becomes the back portion of the sofa, the forward seating section becomes the seat support portion of the sofa, and the intermediate section is stowed in a generally horizontal position, beneath the forward seating support portion, upside down facing the floor. The stowed configuration is shown in FIG. 2 of the patent.

U.S. Pat. No. 8,011,034 discloses an improvement over the design of U.S. Pat. No. 2,740,131. Additionally, when the articulating mechanism is in the folded position, the sofa bed includes a removable seat and back cushions. However, as shown in FIG. 4, the geometry of the articulating mechanism requires the sofa frame to be of a certain shape in order to accommodate the mechanism's stowage. To this end, the profile of the disclosed sofa bed is box-shaped and bulky.

In addition to being constrained in certain aesthetic appeal, prior art sofa beds of the types described above are not easy to use. The bed sections are often heavy, particularly to a large subset of the population, to lift out of the sofa or to stow back into the sofa frame. The high threshold to articulate the sofa bed is often by design to provide stability to the bed sofa when in the deployed and folded configuration. To this end, the sofa bed is less likely to fold while being laid upon or to unfold without clear actions by the user.

In addition, sofa beds are often complicated to manufacture. The components, including the bed sections and the articulating mechanism, are both bulky. The articulating mechanism comprises a series of metallic linkage components of varying shapes, sizes, and angles, while the sofa sections are made of fabric. Great care is often expended to avoid damaging the fabric portion of the sofa section, in particular, during the assembling of the sofa sections to the articulating mechanism.

SUMMARY OF THE EMBODIMENTS

There is now described a convertible sofa bed having a folding apparatus that coordinates the movements of the head panel and middle panel and is substantially compact when the sofa bed is in a folded configuration. The folding apparatus, in one embodiment, includes a mid-swinging member and the rear-swinging member, as part of a rear linkage assembly, and pivotally connects between a head panel (or head panel assembly) and a mounting member. A front-swinging member, as a part of a front linkage assembly of the folding apparatus, and pivotally connects between the middle panel (or middle panel assembly) and the mounting member. The various panels, including the head and middle panels, may be a part of a head panel assembly or middle panel assembly, respectively, having a connecting member to connect between the respective panel and the other linkage components of the folding apparatus to improve manufacturability. The swinging members (front, middle, and rear) control the configuration of the head and middle panel (or respective panel assemblies) as the bed deploys or retracts between a folded configuration and a deployed configuration. In an embodiment, the rear swinging member is the sofa bed's only pivotally mounted linking member being located behind the head panel assembly in the folded configuration along most of the rear swinging member's length.

In one embodiment, the convertible sofa bed includes a locking mechanism for fixably maintaining the head panel (or assembly thereof) in a generally horizontal orientation when the sofa bed is in the deployed configuration and releasing the head panel (or assembly) from the deployed configuration by a lifting motion applied to the middle panel assembly—which lifting motion may be applied to the middle panel by simply lifting the foot panel (or assembly). The locking mechanism is connected between the head panel (or assembly) and the mid-swinging member and, additionally, between the head panel (or assembly) and a connecting arm operatively linked to linkage assembly coordinating movements of the middle panel (or assembly thereof). The sofa bed is configured such that the lifting motion at the middle panel (or assembly) moves the connecting arm to push the locking mechanism from a locked position to an unlocked position. Each of the panels (or assemblies, respectively, thereof) preferably includes an attached mattress section.

In an embodiment, the locking mechanism preferably includes a first linkage member and a second linkage member in which both are pivotally connected to each other. The locking mechanism preferably forms a truss between the head panel (or assembly thereof) and the swinging member when the sofa is in the deployed configuration. The locking mechanism is preferably configured to engage to its locked position immediately upon the middle panel (or assembly) being deployed while providing a hysteresis to the movement of the middle panel (or assembly) to disengage from the locked position. The folding apparatus may be configured to constrain the pivoting of the locking mechanism to no further than a locked position when the bed is in the deployed configuration. To this end, in an embodiment, the mid-swinging member may include a locking pin extending therefrom, and the locking mechanism may have a cam to mate with the locking pin.

The sofa bed may include a bias member to assist in the folding and/or deploying of the sofa bed. The bias member may be configured to bias the foot panel (or assembly thereof) to separate from the middle panel (or assembly)

after the initial lift when the bed is in the deployed configuration and/or as during the deployment of the bed when the bed is in the folded configuration. In an embodiment, the biasing member is located between the foot panel (or assembly) and the middle panel (or assembly). The folding apparatus may include another bias member between the front linkage assembly (connected to the middle panel) and the rear linkage assembly (connected to the head panel) of the folding apparatus.

In another embodiment, a convertible sofa bed is described having a folding apparatus with a forward-linkage assembly and a rear-linkage assembly. The folding apparatus includes a mounting member having a front and a rear end. The forward-linkage assembly is connected at the forward end and the rear-linkage assembly at the rear end. The forward-linkage assembly is pivotally connected to the middle panel (or assembly thereof). As indicated, the various panels, including the head and middle panels, may be a part of a head panel assembly or middle panel assembly, respectively, having a connecting member to improve manufacturability. The rear-linkage assembly is pivotally connected to the head panel (or assembly). The embodiment includes a novel locking mechanism that pivotally attaches both between the head panel (or assembly) and a portion of the rear-linkage assembly and between the head panel (or assembly) and a connecting arm pivotally connected to the forward-linkage assembly. The locking mechanism maintains the head panel (or assembly) in a generally horizontal orientation when the bed is in the deployed configuration and releases the head panel (or assembly) from the deployed configuration by a lifting motion applied the middle panel.

The rear-linkage assembly may include four linkages that form a four-bar linkage. The forward-linkage assembly may include four linkages that form another four-bar linkage. The locking linkage assembly may include two linkages that form yet another four-bar linkage with two linkages common with the four-bar linkage of the rear-linkage assembly. The locking linkage assembly may form a truss between a first linkage and a second linkage of the two linkages common with the rear-linkage assembly when the bed is in the deployed configuration. As a result, the lifting motion of the middle panel (or assembly may move the connecting arm to push the locking mechanism from a locked position to an unlocked position. The rear-linkage assembly constrains the pivoting of the locking mechanism to no further than a locked position when the bed is in the deployed configuration.

In another embodiment, a locking means is provided. The locking means may be connected between the head panel (or assembly thereof) and the mid-swinging member and between the head panel (or assembly) and a connecting arm operatively linked to linkage assembly coordinating movements of the middle panel (or assembly there). The locking means fixably maintains the head panel (or assembly) in a generally horizontal orientation when the sofa bed is in the deployed configuration and releasing the head panel (or assembly) from the deployed configuration by a lifting motion applied to the middle panel (or assembly). The sofa bed is configured such that the lifting motion at the middle panel (or assembly) moves the connecting arm to push the locking means from a locked position to an unlocked position. Each of the panels (or assemblies) preferably includes an attached mattress section. The locking means may include a first linkage member and a second linkage member in which both are pivotally connected to each other. The locking means preferably forms a truss between the head panel section and the swinging member when the sofa is in the deployed configuration. The locking means is preferably configured to engage to its locked position immediately upon the middle panel (or assembly) being deployed while providing a hysteresis to the movement of the middle panel (or assembly) to disengage from the locked position. The folding apparatus may be configured to constrain the pivoting of the locking means to no further than a locked position when the bed is in the deployed configuration. To this end, in an embodiment, the mid-swinging member may include a locking pin extending therefrom, and the locking means may have a cam to contact and limit movement of the locking pin.

In an embodiment, the sofa bed may include a folding apparatus, with the front and rear linkage assemblies, configured as a single module. To this end, the folding apparatus may be manufactured independent of the panels with attached mattress sections. The sofa bed may include a modular leg apparatus having a mounting plate that connects to the middle panel (or assembly) and the foot panel (or assembly). The mounting (or connecting) plate ensures the correct spacing between the leg assemblies so that the correct timing is maintained of one leg folding relative to another. The leg apparatus has a middle leg assembly and panel leg assembly for supporting the middle panel (or assembly) and the leg panel (or assembly), respectively. Each leg assembly may be pivotally connected to the mounting plate to deploy and retract between the bed's folded configuration and the bed's deployed configuration.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1:
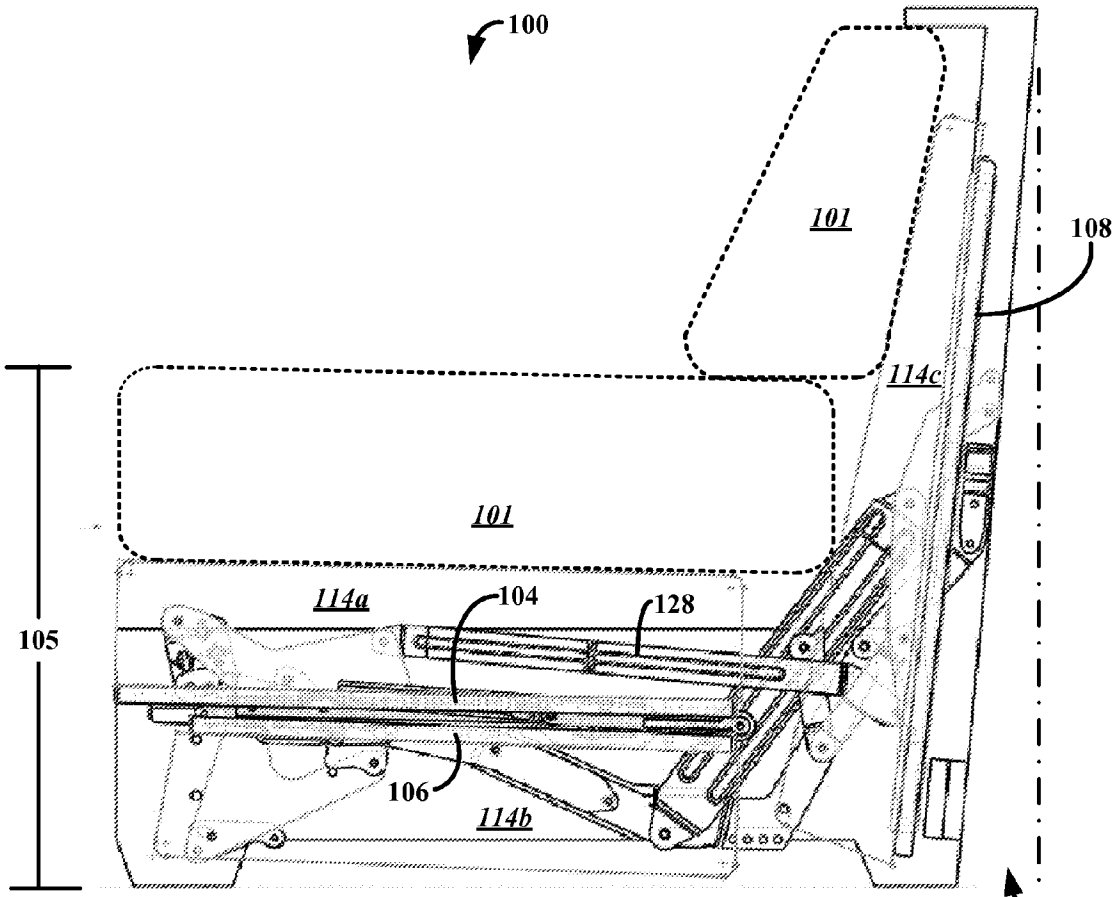
FIG. 1 is a lateral view of an articulated sofa bed in accordance with an embodiment of the invention.

Definitions. As used in this description and the accompanying claims, the following terms shall have the meanings indicated, unless the context otherwise requires:

Where used, the terms "secured," "attached," "connected," "interconnected," "contacting," "mounted," "coupled," "linked," and the like can mean either direct or indirect attachment or contact between elements, unless stated otherwise. Also, spatial terms, such as "under," "below," "lower," "over," "upper," "above," "top," "bottom," "proximal," "distal," "upward," "downward," "backward," "forward," and the like, are used herein for ease of description to describe one element or feature's relationship to another element(s) or feature(s) as illustrated in the figures and are relative to one another. It should be understood that the spatially relative terms are intended to encompass a variety of different spatial orientations of the article as may be placed during in use, operation, or transport of the article, in addition to the specific spatial orientation depicted in the figures. For example, if the article in the figures is inverted 180° within the plane, elements described as "under" or "beneath" other elements or features would then be oriented "over" the other elements or features. The article may be otherwise oriented (rotated 90 degrees or at other orientations) and the descriptors of relative spatial orientations used herein should be interpreted accordingly. The same is true of the terms "backward" and "forward" as the bed is being manipulated from an open to close configuration and vice versa.

In exemplary embodiments, an articulated, convertible sofa bed is configured with a compact, articulating mechanism that allows for the sofa bed to have a more contemporary silhouette, compared to traditional sofa beds, while also convertible to any conventional sized bed units. To this end, the sofa bed of the present embodiment has a back region that is angled to provide an aesthetic appeal similar to that of contemporary sofas. Another exemplary embodiment of the articulated, convertible sofa bed is disclosed in co-pending, co-owned U.S. patent application Ser. No. 13/653,945, by Thomas A. Garland, titled "Foldable Articulated Sofa Bed." This application is incorporated herein by reference in its entirety.

In another aspect of the embodiment of the invention, an exemplary locking mechanism is employed to provide stability to the sofa bed in its respective bed or sofa configuration. The sofa bed can, thus, be configured with non-motorized means to assist in converting between the sofa configuration and the bed configuration to which the threshold of the necessary force to perform the conversion is comfortable to a large subset of the adult population. In an embodiment, after the foot panel is initially lifted, the sofa bed assists in pulling the middle and foot panel sections into the folded configuration as well as in pushing the middle and foot panel sections into the deployed configuration. Additionally, the sofa bed may be assembled with components organized in modules. To this end, metallic linkage components, such as that of the articulating mechanism, may be pre-assembled separately from non-metallic components that are subject to being damaged or scratched. The modules may then be combined during final assembly to reduce manufacturing costs and reduce such risks of inadvertent damage or scratching.

FIG. 1 schematically illustrates an articulated sofa bed 100 in accordance with an embodiment of the invention. The sofa bed 100 is depicted in a fully folded position with cushions 101 placed thereupon. The rear of the sofa bed 100 forms an angle 103 from the vertical plane such that its lower end is shifted toward the front end of the sofa bed 100. The angle 103 measures preferably between about 3° to 10° (±0.5°), even more preferably at about 6° (±0.5°).

Additionally, the folded portion of the sofa bed is configured in a manner that the overall height 105 of the sofa bed 100 can be made comparable to that of a conventional sofa while also having cushions with comfortable thicknesses. To this end, the non-mattress section of the sofa bed, including the floor clearance, requires less than 3.25 inches of space of the overall height 105 of the seating surface. As such, two foldable mattress sections, each having a thickness of five inches, and a cushion section having a thickness of seven inches would result in a seating height of less than 20.5 inches.

Figure 2:
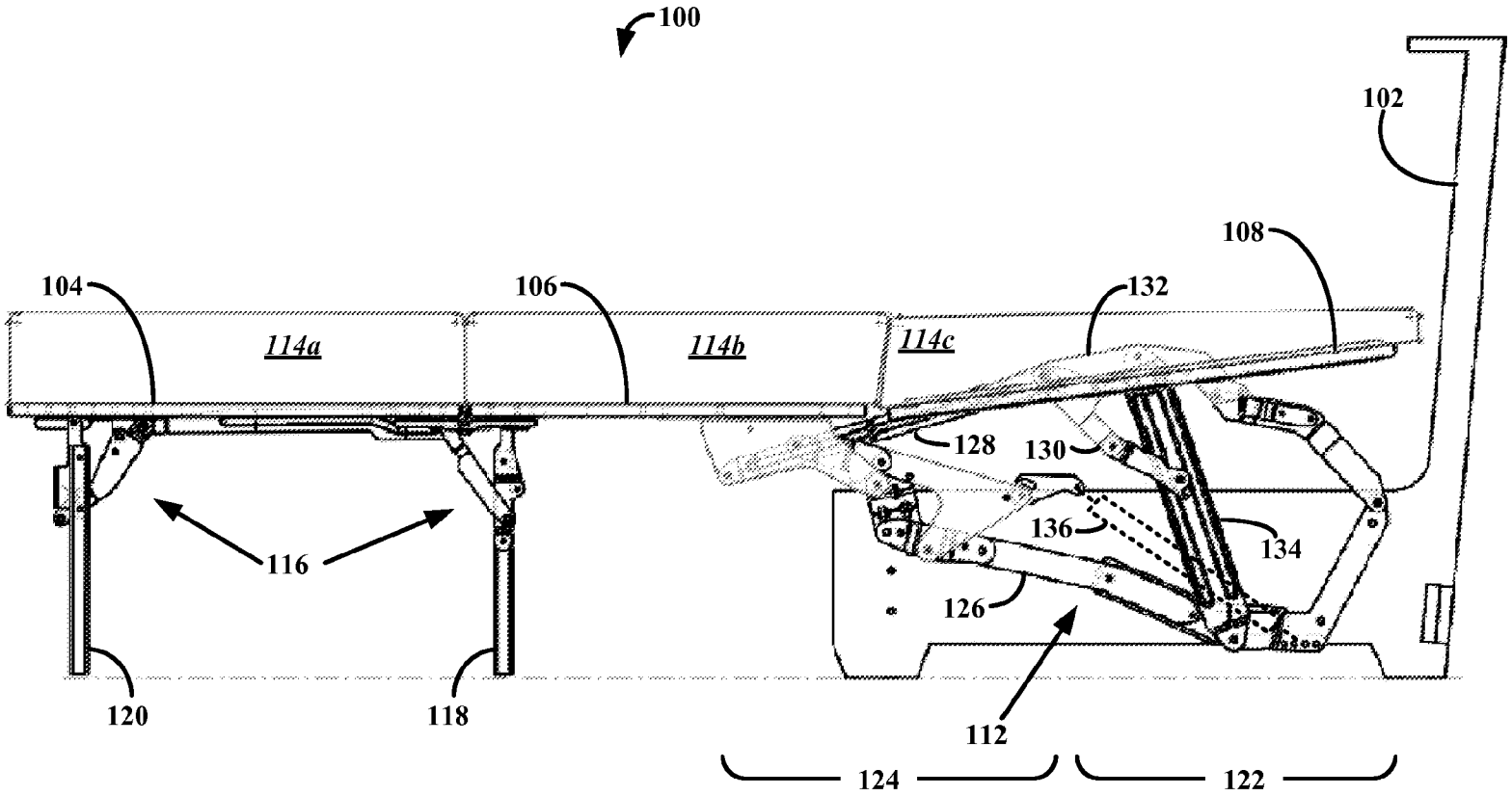
FIG. 2 is a lateral view of the articulated bed of FIG. 1 in a deployed configuration.
Figure 3:
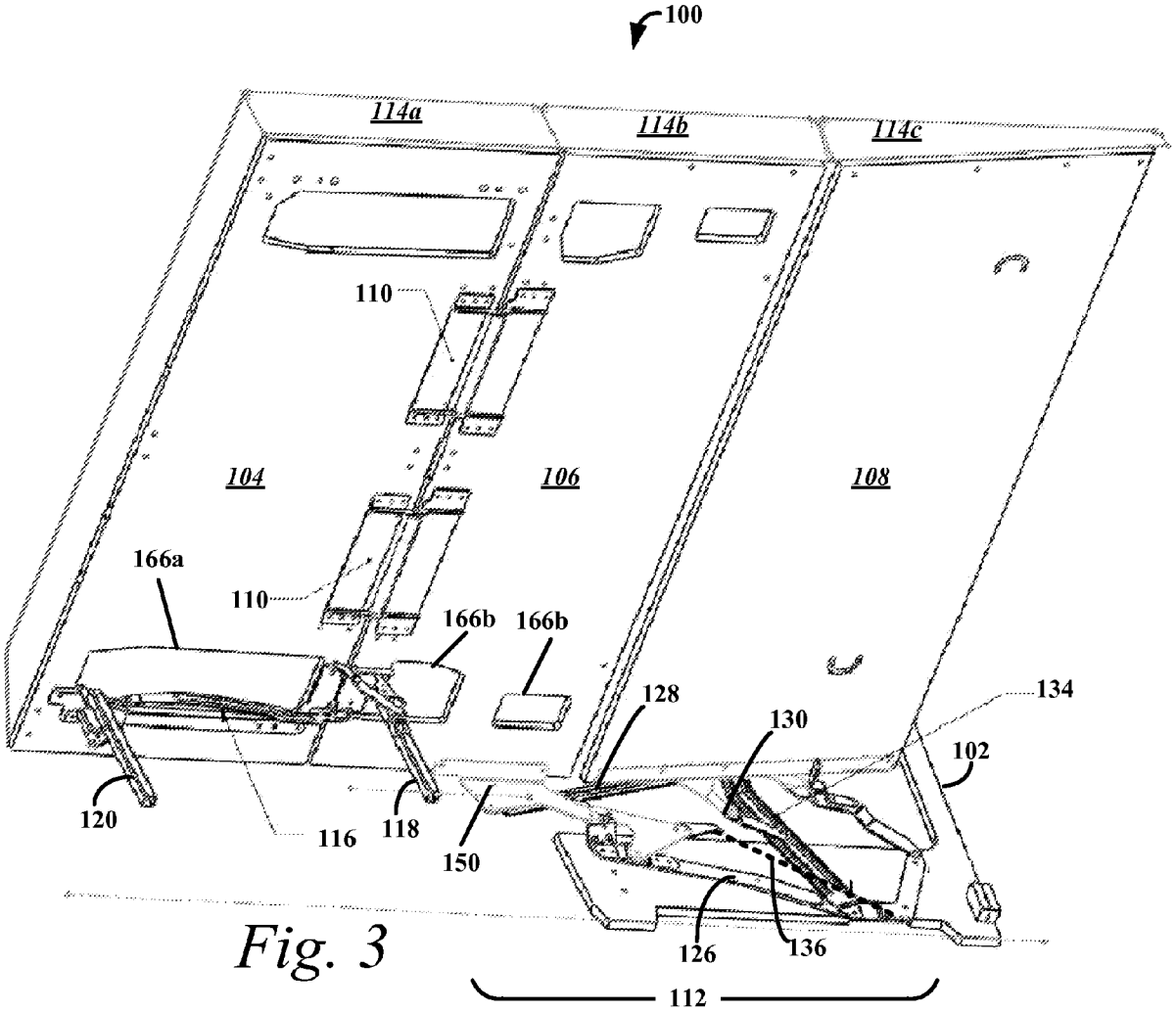
FIG. 3 is a bottom perspective view of the articulated sofa bed of FIG. 1 in the deployed configuration.

FIGS. 2 and 3 schematically illustrate an articulated sofa bed 100 in the deployed configuration in accordance with an embodiment of the invention. The sofa bed 100 includes a sofa frame 102 with three retractable panels: a foot panel 104, a middle panel 106, and a head panel 108. The foot panel 104 is pivotally connected to the middle panel 106 via torsional-hinge assemblies 110 (see FIG. 3) and via mounting members 176, 178 (See FIGS. 15 and 17). The middle panel 106 is connected to the head panel 108 via a folding apparatus 112. Each panel (104, 106, 108) has a mattress portion (114*a*, 114*b*, 114*c*, respectively) attached thereon. Each of the panels 104, 106, 108 and its respective mattress sections 114*a*, 114*b*, 114*c*, in combination, are referred to as a section—specifically, the "foot-panel section" the "middle-panel section" and the "head-panel section."

In the deployed configuration, the panel sections are supported by a leg assembly 116, the folding apparatus 112, and the sofa frame 102 to form a bed. Specifically, the sofa frame 102 and the folding apparatus 112 support the middle-panel section and the head-panel section. The leg assembly 116 has a middle-panel leg 118 and a foot-panel leg 120. The middle-panel leg 118 is located below the middle panel 106 and supports the middle-panel section and the foot-panel section. The foot-panel leg 120 is located below the foot panel 104 and supports the foot-panel section. In the folded configuration, the folding apparatus 112 supports all the panel sections as they are arranged on top of one another and stowed in the sofa frame 102.

The folding apparatus 112 guides the movements of the head panel 108 and the middle panel 106 between their respective deployed and folded configuration. The folding apparatus 112 includes two linkage assemblies: a rearmost-linkage assembly 122 and a foremost-linkage assembly 124, which share a common mounting arm 126. Each mounting arm 126 is connected to a respective arm of the sofa frame 102 (see FIGS. 2 and 3), preferably by bolts. The combination of the panels 104, 106, 108 or panel sections with at least one linkage component of either linkage assembly 122, 124 is herein referred to as a "panel assembly"—specifically, the "foot panel assembly," the "middle panel assembly," and the "head panel assembly." For example, the head panel assembly may refer to the head-panel section or head panel 108 in conjunction with a connecting linkage of the rearmost-linkage assembly 122 to which it is connected.

Referring to FIGS. 1-3, the rearmost-linkage assembly 122 connects to the head panel 108 and guides the movement of the head panel 108 between its respective deployed and folded configuration. In the deployed configuration (FIG. 2), the head panel 108 is in a generally horizontal orientation with its mattress section 114*c* facing up; while in the folded configuration (FIG. 1), the head panel 108 is in a generally vertical orientation (preferably within 10 degrees of vertical) and located at the back of the sofa frame 102 with its mattress section 114*c* facing forward.

The foremost-linkage assembly 124 connects to the middle panel 106 and guides the movement of the middle panel 106 between its respective deployed and folded configurations. In the deployed configuration (FIG. 2), the middle panel 106 is in a generally horizontal orientation and located above the folding apparatus 112 with its mattress section 114*b* facing up; while in the folded configuration (FIG. 1), the middle panel 106 is in the generally horizontal orientation with its mattress section 114*b* being proximal to the floor and facing down.

The torsional-hinge assemblies 110 (see FIG. 3) and the leg assembly 116—in particular mounting members 176, 178 (see FIGS. 15 and 17) of the leg assembly—pivotally connect the foot panel 104 and the middle panel 106. Each of the torsional-hinge assemblies 110 preferably includes a torsional spring for applying a torque to the panels 104, 106 when in the folded configuration. To this end, the torsional-hinge assemblies 110 reduce the lifting force required for the initial lift of the panels 104, 106 during deployment. In the deployed configuration (FIG. 2), the foot panel 104 is in a generally horizontal orientation and located above the folding apparatus 112 with its mattress section 114*a* facing up, while in the folded configuration (FIG. 1), the foot panel 104 is in the generally horizontal orientation and located above the middle-panel section with its mattress section 114*a* facing up.

A connecting arm 128 pivotally connects between the rearmost-linkage assembly 122 and the foremost-linkage assembly 124 to coordinate the movements between the front and middle panels 104, 106 and the head panel 108. To this end, movements at the foot and middle panels 104, 106 are transferred to the head panel 108. A locking mechanism 130, also referred to as a locking linkage assembly 130, is connected between linkages of the rearmost-linkage assembly 122 for securing the head panel 108 in place in the deployed configuration. The locking linkage assembly may include at least two linkage members.

The folding apparatus 112 may include a bias member 136 operatively connected between the rearmost-linkage assembly 122 and the foremost-linkage assembly 124 to assist a person in the folding or deploying of the sofa bed 100. In an embodiment, after the initial lift, the force necessary to deploy or fold the sofa bed 100 is preferably less than ten pounds, even more preferably less than five pounds.

As indicated, the sofa bed 100 may be assembled with components organized in modules for improved manufacturability. Looking at FIGS. 2 and 3, the folding apparatus 112 is organized such that it contains all the articulating linkages for connecting to the middle-panel section and the head-panel section. Specifically, a member of the folding apparatus 112 (i.e., the head-panel connecting member 132 of the rearmost-linkage assembly 122) connects to the head-panel 108; another member of the folding apparatus 112 (i.e., the mid-panel connecting member 150 of the foremost-linkage assembly 124) connects to the middle-panel 106; and the mounting arm 126 of the folding apparatus 112 connects to the sofa frame 102. The mid-panel connecting member 150 may also be referred to as a "front-swinging member 150." As a result, the folding apparatus 112 can be assembled independent of such panel sections.

Moreover, in an embodiment, the foot-panel section, the middle-panel section, and the head-panel section may be separate and independent of one another and linked only through the folding apparatus 112 and the leg assembly 116. In the embodiment shown in FIG. 3, the middle panel 106 and the foot panel 104 are further connected with the torsional-hinge assemblies 110. The leg assembly 116, to be discussed in greater detail below, includes (i) a first connecting member 119 (see FIG. 15) to connect to both the foot-panel section and the middle-panel section, and (ii) a second connecting member 121 to connect to the foot-panel section. The leg assembly 116 is also organized as a single module to connect to both the middle-panel section and the foot-panel section.

Figure 4:
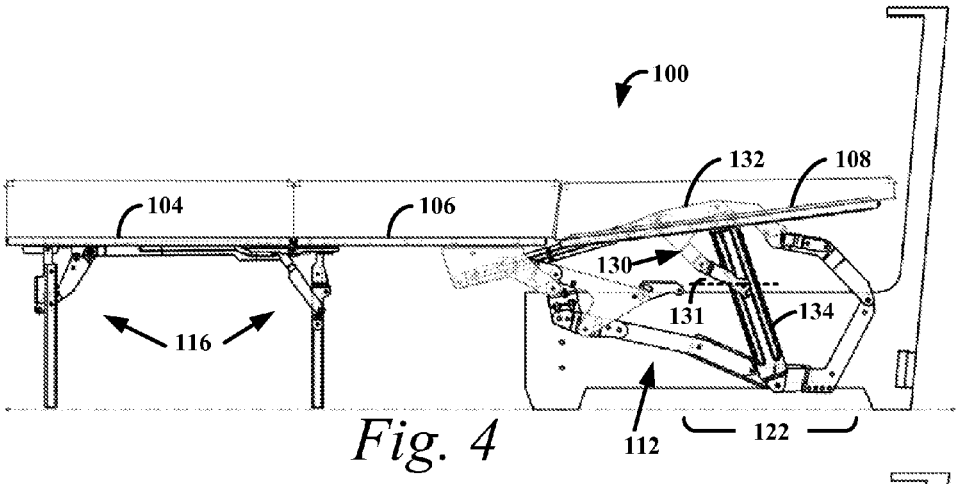
FIGS. 4-9 are lateral views of the articulated sofa bed of FIG. 1 as it is folded into the sofa frame from the deployed configuration to a folded configuration.

The modules may be designed such that they can be packaged as small shipping units. Referring to FIGS. 4-9, the sofa bed 100 is shown being transformed from the bed configuration to the sofa configuration in accordance with an embodiment. As shown in FIG. 4, the sofa bed 100 is fully unfolded in the deployed configuration as a bed, while as shown in FIG. 9, the sofa bed 100 is fully folded in the folded configuration as a sofa and is ready to receive the cushions 101.

Looking at FIG. 4, the articulated sofa bed 100 is shown with the folding apparatus 112 in a deployed configuration in which the bed is in a fully open configuration. In this configuration, the head panel 108 is in a generally horizontal orientation and can be made to move only toward the folded configuration. The locking mechanism 130 is connected between two linkages 132, 134 of the rearmost-linkage assembly 122, specifically the head-panel connecting member 132 and the mid-swinging member 134. The locking mechanism 130 forms a truss with the head panel 108 to secure the head panel 108 in a stabilized manner. Specifically, the truss may be characterized as an angle 131 to a horizontal plane, the angle 131 measuring preferably between 30 and 75 degrees, even more preferably between 50 and 55 degrees.

Looking at FIG. 5, the locking mechanism 130 is configured to unlock with the lifting of the foot panel 104 (by means of connecting arm 128, which is discussed below). This unlocking allows the head panel 108 and the rearmost linkage assembly 122 to move. After the initial lift, the apparatus 112 begins coordinating the movement of the middle and foot panel sections into the folded configuration. The bias member 136 may be provided to help rotate the middle panel 106 to assist in pulling the middle panel 106 and the foot panel 104 into the folded configuration.

Specifically, as the foot panel 104 is initially lifted in an upward motion (arrow 123), the middle panel 106 is also caused to be lifted by its connection to the foot panel 104 via the torsional-hinge assemblies 110 and the foot assembly 116. The torsional-hinge assemblies 110 and the leg assembly 116 are configured to preferably maintain the middle panel 106 coplanar and adjacent to the foot panel 104 during the initial lift. The middle panel 106, in turn, rotates the mid-panel connecting member 150 of the foremost-linkage assembly 124 at pivot point 150*a* (see dotted arrow at 150) causing the mid-panel connecting member 150 to pivot upward and towards the rear. This motion pushes, via the connecting arm 128, both (i) the locking mechanism 130 causing it to rotate from its locked position and (ii) the head-panel connecting member 132 to move linkages of the rearmost-linkage assembly 122. As the locking mechanism 130 is moved from its locked position, the forward portion 108*b* of the head panel 108 begins to move downward while the rear portion 108*c* moves upward (see dotted arrows near 108*b*, 108*c*). The bias member 136 may provide a force to assist in drawing the foremost-linkage assembly 124 and the rearmost-linkage assembly 122 together, thereby reducing the lifting force 123 necessary to lift the foot panel 104. To this end, the conversion of the sofa bed from the deployed configuration to the folded configuration can be easily performed by most adults.

Figure 5:
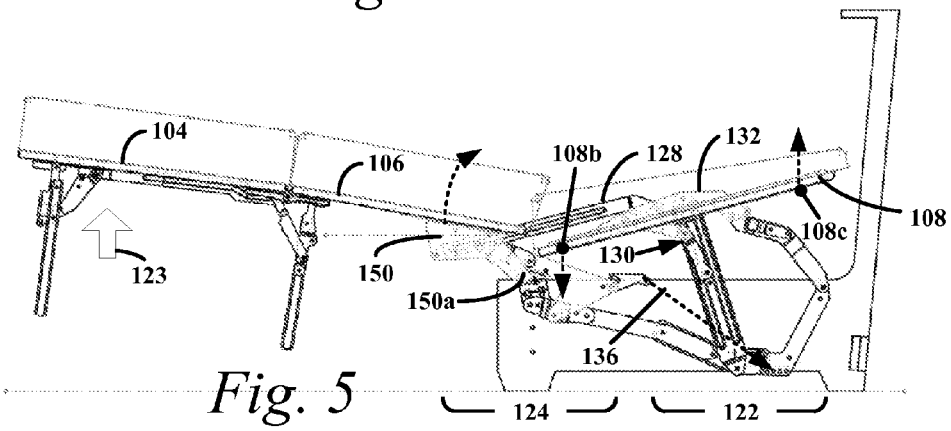
Figure 6:
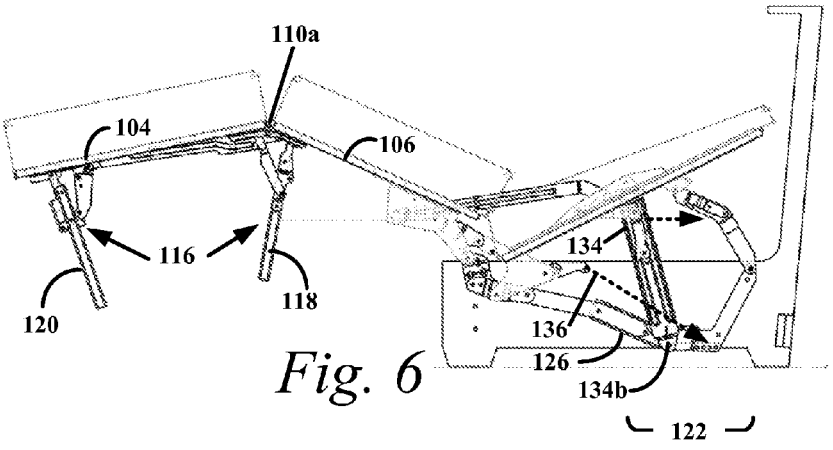

Looking at FIG. 6, the foot panel 104 and middle panel 106 are in a higher lifted position compared to FIG. 5. At this position, the weight of the foot-panel section causes the foot panel 104 to pivotally rotate at pivot point 110*a* with respect to the middle panel 106. The rotation causes the leg assembly 116 to begin retracting the middle-panel leg 118 and the foot-panel leg 120 to their stowed/folded position. Additionally, the higher position causes the rearmost-linkage assembly 122 to begin folding. To this end, the mid-swinging member 134 is pivotally rotating, at pivot point 134*b*, with respect to the mounting arm 126 resulting in the top portion of the mid-swinging member 134 shifting rearward (see dotted arrow near 134).

Figure 7:
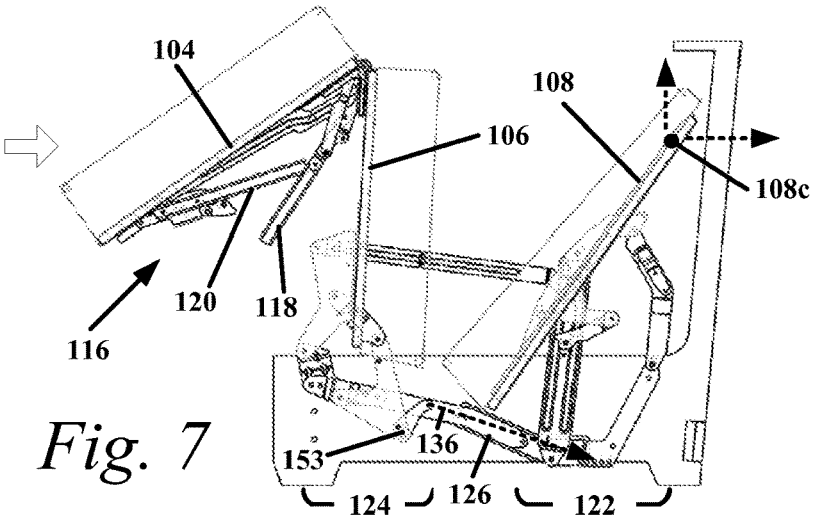

Looking at FIG. 7, the foot panel 104 is at the highest lifted position and the middle panel 106 is in a generally vertical orientation. At this intermediate position (between the deployed configuration and the folded configuration), the rearmost-linkage and foremost-linkage assemblies 122, 124 are preferably configured to transition from drawing together to separating apart—and, accordingly, the bias member 136 transitions from shortening to stretching. This biasing controls the descent of the middle-panel section and the foot-panel section into their stowed position (FIG. 9). It should be appreciated by those skilled in the art that the same biasing also provides the assisting force in raising the middle-panel section and the foot-panel section from the stowed position to this intermediate position. (Similarly, the torsional-hinge assemblies 110, shown in FIG. 3, may impart a torque around pivot point 110*a* to reduce the initial lifting force for lifting the foot panel 104 out of the folded configuration, shown in FIG. 9.)

At this position, it is observed that the rearmost-linkage assembly 122 is elongating vertically and narrowing horizontally resulting in the rear portion of the head panel 108*c* shifting upward and rearward (see dotted arrows near 108). The folding of the middle panel 106 and the foot panel 104 causes the leg assembly 116 to fold the middle-panel leg 118 and a foot-panel leg 120. The leg assembly 116 is configured to fold the foot-panel leg 120 earlier than middle-panel leg 118 to avoid the foot-panel leg 120 being caught against middle panel 106.

Figure 8:
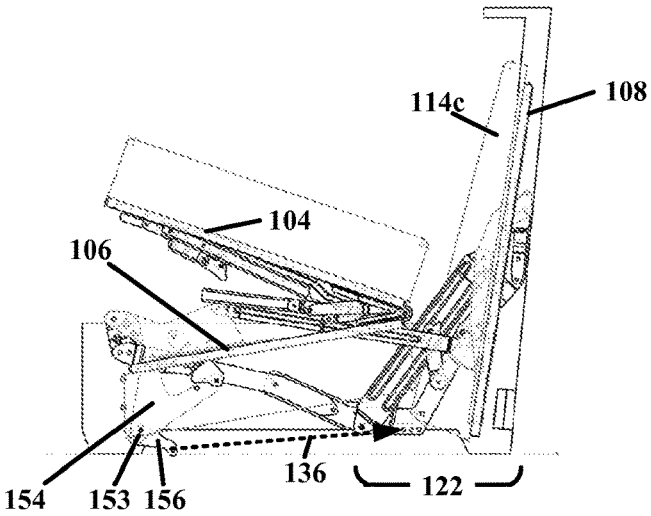
Figure 9:
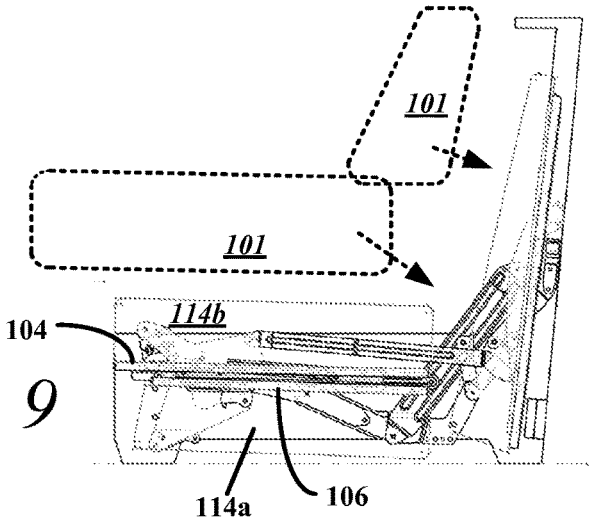

Looking at FIG. 8, the head panel 108 and the rearmost-linkage assembly 122 are almost in their respective stowed/folded configuration, while the foot panel 104 and the middle panel 106 are in their respective near stowed/folded configuration. To this end, the head panel 108 is in a generally vertical orientation with the mattress portion 114*c* facing forward.

Looking at FIG. 9, the foot panel 104 and the middle panel 106 reached their respective stowed/folded configuration. To this end, the foot panel 104 is in a generally horizontal position proximal to the floor with its mattress portion 114*a* facing down. The middle panel 106 is in a generally horizontal and located above the foot panel 104 with its mattress portion 114*b* facing up ready to receive the cushions 101.

Figure 10:
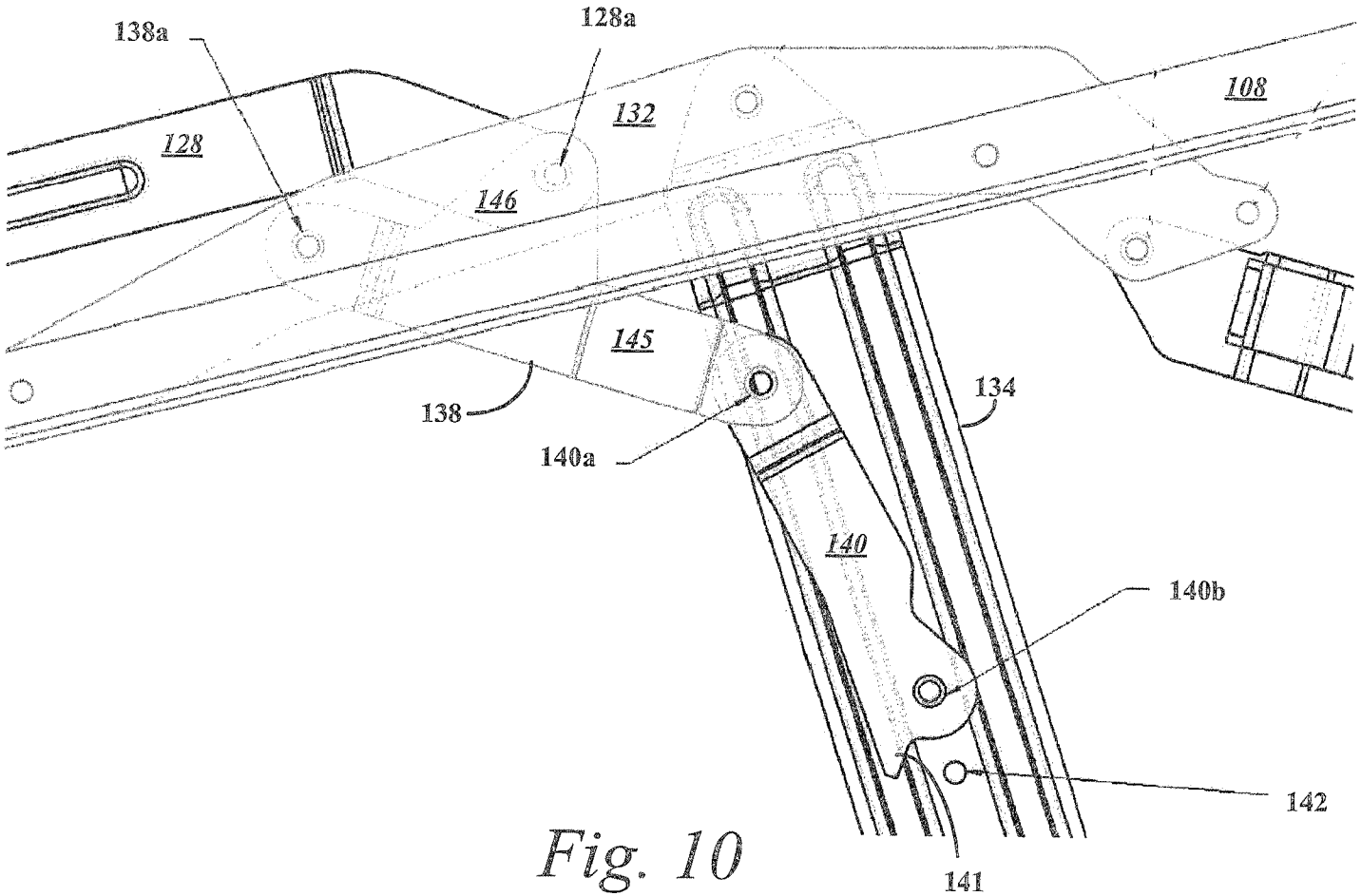
FIG. 10 shows a locking mechanism of the articulated sofa bed of FIG. 1 in accordance with an embodiment of the invention.
Figure 11:
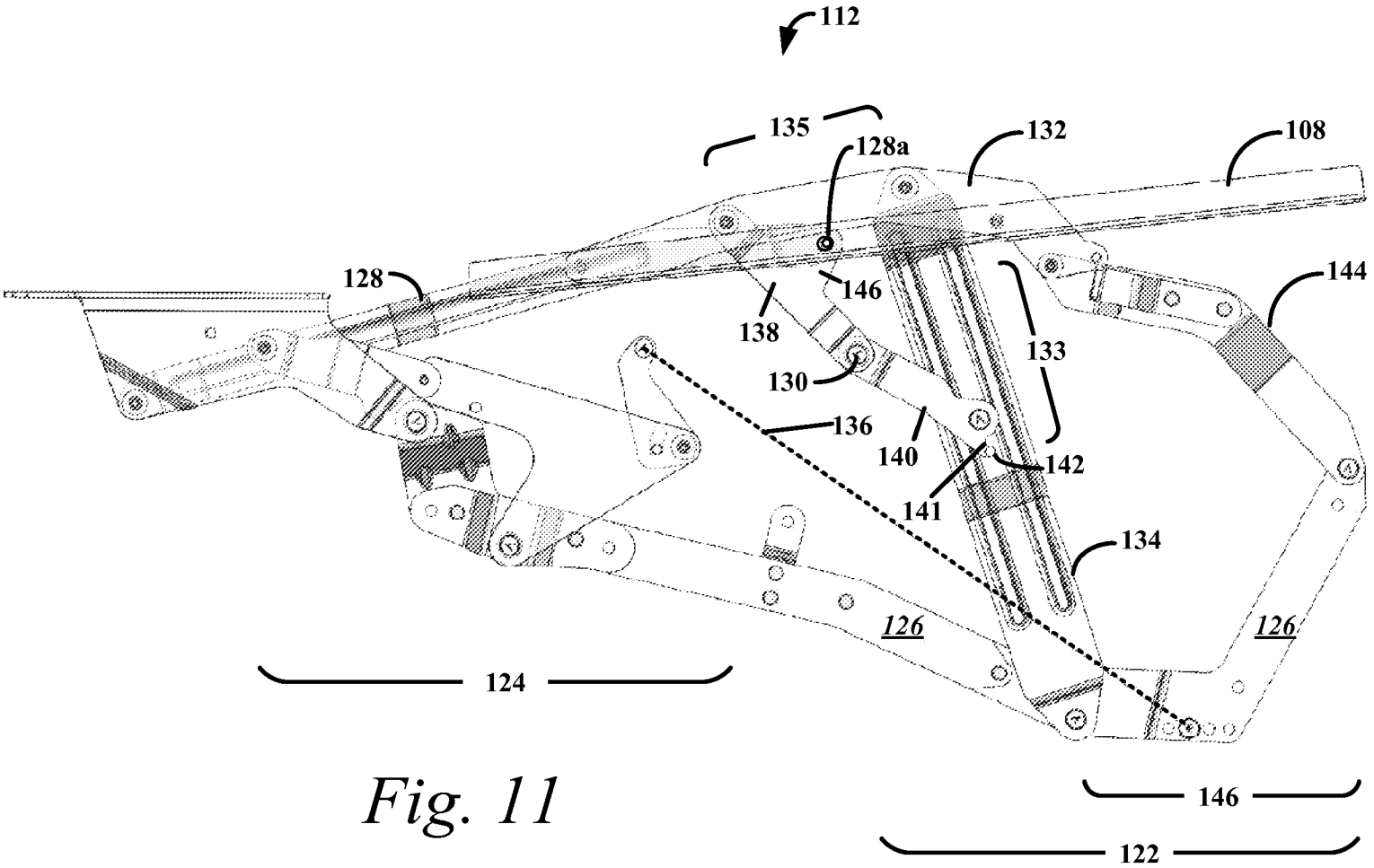
FIGS. 11-14 are lateral views of a folding apparatus of the articulated sofa bed of FIG. 1, the folding apparatus being configured with the locking mechanism.

Referring to FIGS. 10 and 11, the locking mechanism 130 according to an embodiment is now described. Specifically, the locking mechanism 130, in this embodiment, has (i) a first locking member 138 that pivotally connects both to the head-panel connecting member 132 and the connecting arm 128, and (ii) a second locking member 140 that pivotally connects to the first locking member 138 and the mid-swinging member 134. The first locking member 138 and the second locking member 140 may also be referred to, respectively, as a "first linkage member 138" and a "second linkage member 140" of the locking mechanism 130. The first and second locking members 138, 140 form a rigid truss structure for supporting the head panel 108 when the head panel 108 is in the generally horizontal orientation, as illustrated in FIGS. 2 and 3.

The locking mechanism 130 includes a means for constraining the pivoting of the locking mechanism no further than the locked position. To this end, the locking mechanism 130 includes a cam 141 that pivotally rotates to a stop surface 142, preferably disposed on the mid-swinging member 134, to maintain the locking mechanism 130 at the locked position. The movement of the head panel 108 into a generally horizontal orientation causes the locking mechanism 130 to lock the head panel 180 to the generally horizontal orientation. In an embodiment, the stop surface 142 is a pin extending from the side wall preferably at the middle section of the mid-swinging member 134. The cam 141 may be alternatively shaped as a pin. When in the locked position, the locking mechanism 130 fixably maintains the head panel 108 in a generally horizontal orientation and is free to pivotally rotate only to the unlocked position. Specifically, the rotation of the head panel 108 toward the deployed configuration orients the head-panel connecting member 132 and the connecting arm 128 in a manner to rotate the components of the locking mechanism 130 so that the cam 141 pivotally rotates to the stop surface 142. The locked position forms an angle measuring preferably between 30 and 70 degrees, even more preferably between 40 and 50 degrees, with the horizontal plane. It should be appreciated by those skilled in the art that the location of the stop surface 142 is merely illustrative as other locations along the mid-swinging member 134 or the mounting arm 126 may be employed.

The first locking member 138 preferably includes a longitudinal-member portion 145 with a side-member portion 146 to connect to the connecting arm 128. The side-member portion 146 may be referred to as an "elbow region." The first locking member 138 connects to the head-panel connecting member 132 at hinge 138*a* and to the connecting arm 128 at a sliding hinge 128*a* (discussed in more detail below). The second locking member 140 connects to the first locking member 138 at hinge 140*a* and to the mid-swinging member 134 at hinge 140*b*.

When the sofa bed 100 is deployed, the locking mechanism 130 acts as a rigid structure, between the head-panel connecting member 132 at hinge 138*a* and the mid-swinging member 134 at hinge 140*b*, to maintain the head panel 108 in a fixed generally horizontal orientation. To this end, the connecting arm 128 and the stop surface 142 maintains the orientation of the locking mechanism 130, with respect to pivot point 138*a*, allowing for weight to be applied onto the head panel 108 without releasing the locking mechanism 130. Specifically, when weight is applied to the head panel 108, it forces the cam 141 against the stop surface 142 and thus precludes the mid-swinging member 134 from closing the angle 131 formed between the mid-swinging member 134 and a horizontal plane. Moreover, a rotation by the connecting arm 128 releases the locking mechanism 130 from the locked position allowing for the sofa bed 100 and the rearmost-linkage assembly 122 to fold.

It should be appreciated by those skilled in the art that the shapes and dimension of the locking members 138, 140 are merely illustrative. To that end, the first locking member 138 may be configured with other shapes, such a T-shape, D-shape, Y-shape, among others.

Figure 12:
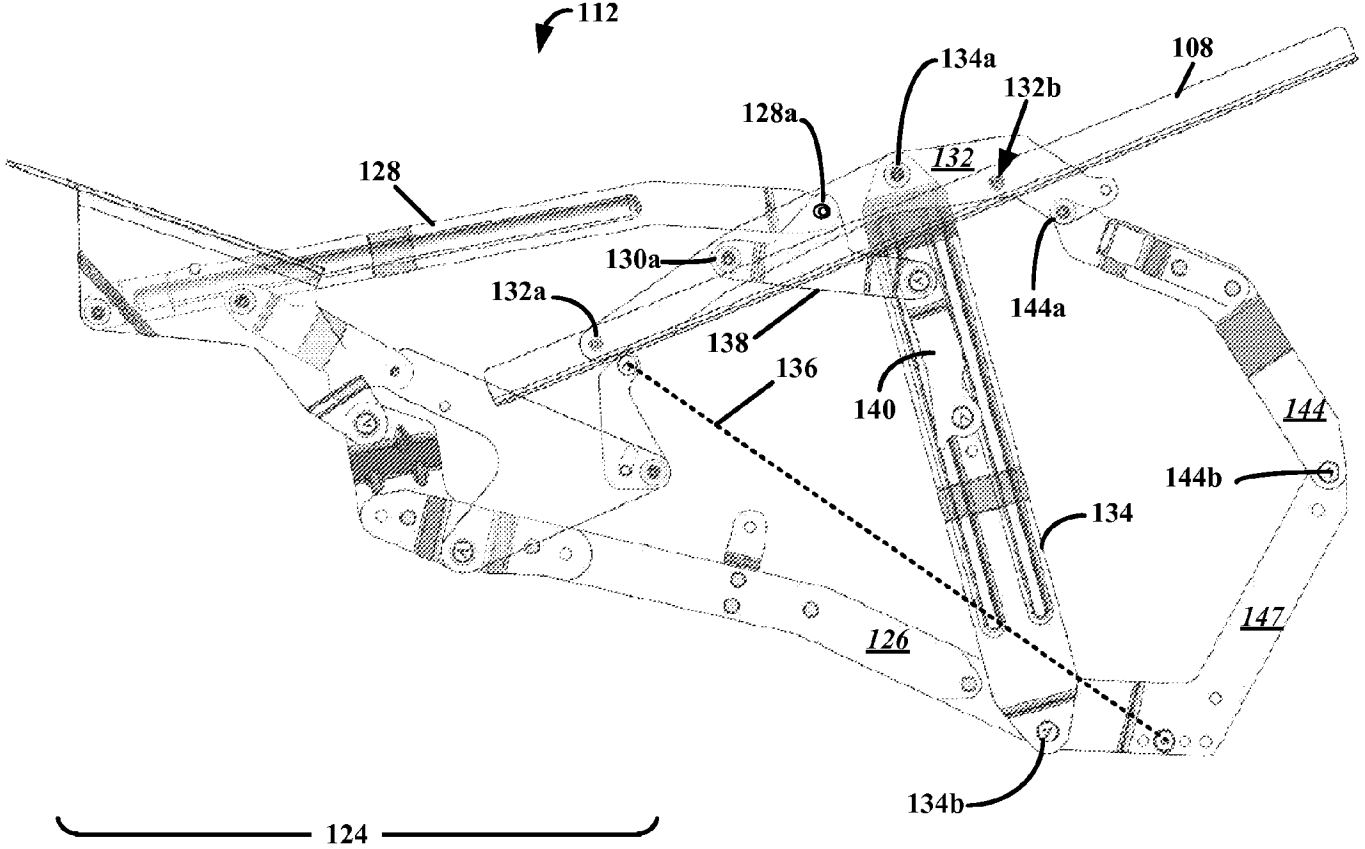
Figure 13:
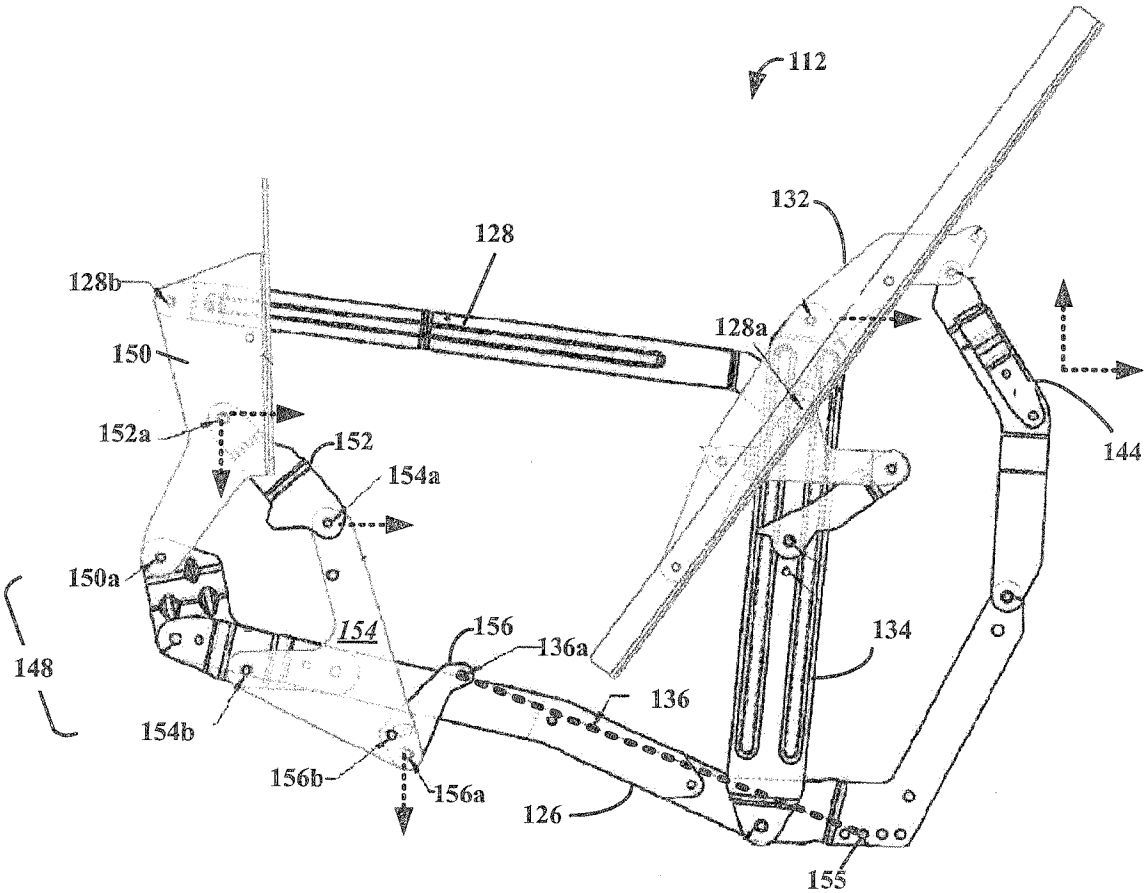
Figure 14:
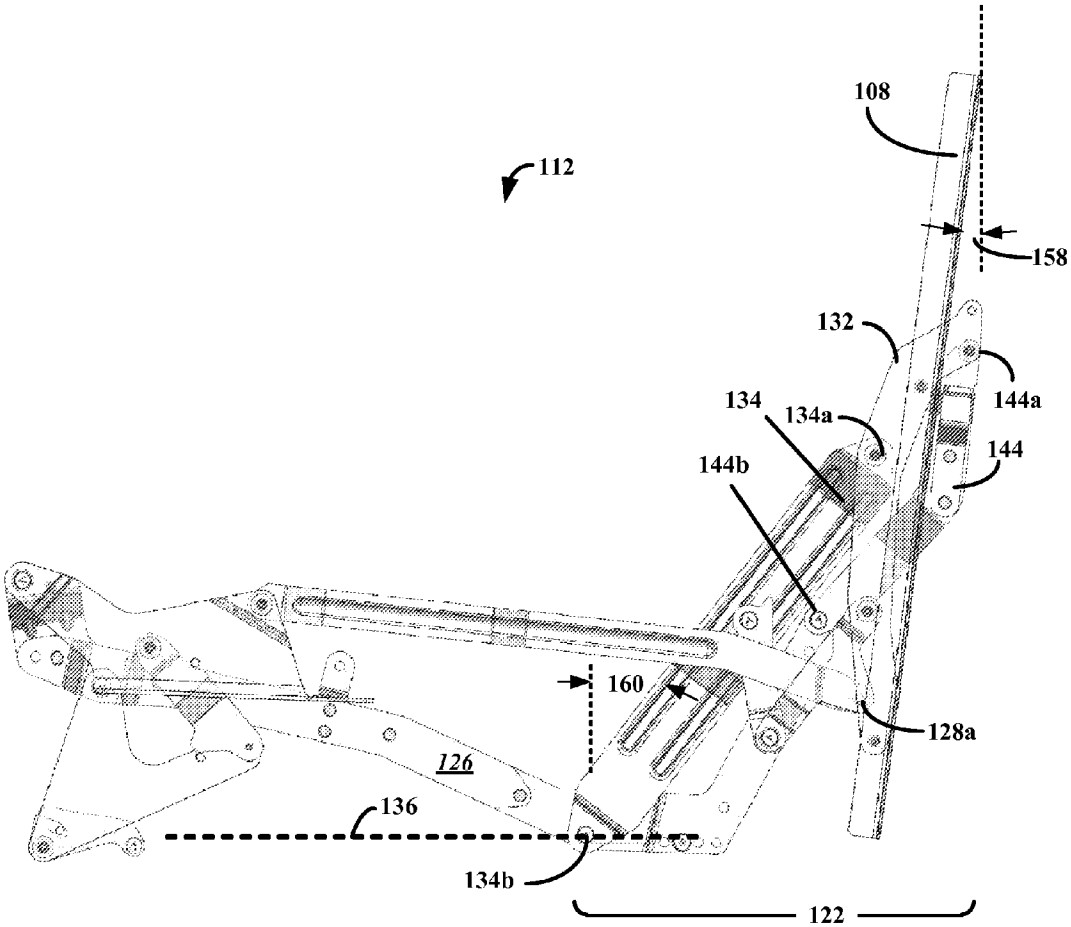

Referring now to FIGS. 11 to 14, the folding apparatus 112 is discussed. For ease of illustration, only one set of deployment mechanism is described, but the sofa bed 100 comprises two sets, one on each side of the bed frame, the right and left side. The folding apparatus 112 comprises the rearmost-linkage assembly 122 and the foremost-linkage assembly 124. Generally, the rearmost-linkage assembly 122 controls the movement of the head panel 108, while the foremost-linkage assembly 124 controls the movement of the middle panel 106. In FIG. 11, the apparatus 112 is shown in the fully deployed configuration with the locking mechanism 130 in the locked position, corresponding roughly to FIG. 4. Similarly, FIG. 12 shows the apparatus 112 as it begins to fold corresponding roughly to FIG. 5; FIG. 13 shows the apparatus 112 at the transition position corresponding roughly to FIG. 7; and FIG. 14 shows the apparatus 112 in the stowed/folded position as shown in FIG. 9.

Looking at FIG. 11, the rearmost-linkage assembly 122 is preferably a four-bar linkage having at least four bodies connected in a closed chain, including a rear portion 146 of the mounting arm 126, the head-panel connecting member 132, the mid-swinging member 134, and a rear-swinging member 144. Specifically, the head panel 108 is movably secured, by the head-panel connecting member 132, to the rear-swinging member 144 and the mid-swinging member 134, both of which are movably secured to the mounting arm 126.

The head panel 108 is preferably connected to the head-panel connecting member 132. To this end, the head-panel connecting member 132 may be assembled to the other linkage members to form the four-bar linkage independent of the head panel 108 and the mattress portion 114*c*, both of which can later be assembled to the apparatus 112. Of course, it should be appreciated that the head panel 108 may alternatively be configured with the mounting points of the head-panel connecting member 132 as a head panel sub-assembly, which may then be connected to the mid-swinging member 134, the rear-swinging member 144, and the connecting arm 128.

Still looking at FIG. 11, the locking mechanism 130 preferably forms a second four-bar linkage sharing two linkage members with the rearmost-linkage assembly 122 to maintain the rearmost-linkage assembly 122 in a fixed configuration when the locking mechanism 130 is in a locked position. Specifically, the second four-bar linkage of the locking mechanism 130 includes the first locking member 138, the second locking member 140, the upper portion 133 of the mid-swinging member 134, and a middle portion 135 of the head-panel connecting member 132. To this end, portions 133, 135 of the mid-swinging member 134 and the head-panel connecting member 132 are shared between the four-bar linkage of the locking mechanism 130 and the four-bar linkage of the rearmost-linkage assembly 122. The shared linkages fixably secure movements of the rearmost-linkage assembly 122 when the locking mechanism 130 is in its locked position. Moreover, through the shared linkage, the connecting arm 128, which connects to locking mechanism 130 and, thus, to the head-panel connecting member 132 through the first locking member 138, is able to cause the rearmost-linkage assembly 122 to move when the apparatus 112 is folding or unfolding.

Referring to FIGS. 10 and 11, during the unfolding of the apparatus 112, the movement of the connecting arm 128 pulls at the side-member portion 146 of the first locking member 138 at sliding hinge 128*a* to cause the bottom portion of the first locking member 138 to shift forward. The motion causes the top portion of the second locking member 140 to also shift forward until the cam 141 mates with the stop surface 142, thereby retaining the locking mechanism 130 in the locked position. When the locking mechanism 130 rotates to the stop surface 142, the first locking member 138 restrains the connecting arm 128 from further movement, restraining the foremost-linkage assembly 124 from further rotation.

During the folding of the apparatus 112, the movement by the connecting arm 128 causes the sliding hinge 128*a* to shift slightly in a generally horizontal direction, and then to rotate the first locking member 138 and unlock the locking mechanism 130 from the stop surface 142. To this end, the movement of the connecting arm 128 may be initiated by movement of the middle panel 106 (and accordingly by movement of the foot panel 104). The rotation of the middle panel then causes the foremost-linkage assembly 124 to rotate.

Continuing to refer to FIGS. 10 and 11, the sliding (or slotted) hinge 128*a* is preferably shaped as a short slot in connecting arm 128 to allow for both rotation and some linear displacement between the connecting arm 128 and the first locking member 138. The sliding hinge 128*a* receives a pin 146*a*, which is fixed to the side-member portion 146 of the first locking member 138. With this arrangement with the sliding hinge 128*a*, the locking mechanism 130 is configured to engage its locked position immediately upon the middle panel 106 being deployed, but a hysteresis is provided so that a small amount of movement or bending of the first locking member (relative to the connecting arm 128) is permitted before the locking mechanism is unlocked.

In FIGS. 10 and 11, the sliding hinge 128*a* is shown with a minute open space, as a slot, at the forward side of the pin 146*a*. This slot allows the first locking member 138 (including side-member portion 146) to deflect downward and slightly toward the foot of the bed, as can be the case under the load of several people (or jumping) on the head panel 108. The hysteresis thus prevents load-caused deformation of linkage members of the apparatus 112 from unlocking the locking mechanism 130. Essentially, the connecting arm 128 tends to stay fixed under downward load on the middle panel 106, but the pin 146*a* is allowed to move slightly through the sliding hinge 128*a* toward the foot of the bed.

Looking at FIG. 12, the head-panel connecting member 132 connects (i) to the head panel 108 at locations 132*a* and 132*b*, located at its forward and rear region, (ii) to the mid-swinging member 134 at its mid-section region at hinge 134*a*, (iii) to the rear-swinging member 144 at hinge 144*a*, and (iv) to the locking mechanism 130 at hinge 130*a*. The head-panel connecting member 132 is elongated and positioned about the mid-section of the head panel 108. The rear-swinging member 144 has (i) a forward end connecting, at hinge 144*a*, to the head-panel connecting member 132, and (ii) a rearward end connecting, at hinge 144*b*, to the rear region 147 of the mounting arm 126. The mid-swinging member 134 connects (i) to the head-panel connecting member 132 at hinge 134*a*, and (ii) to the middle section of the mounting arm 126 at hinge 134*b*.

Looking at FIG. 13, the foremost-linkage assembly 124 is now described in detail. The foremost-linkage assembly 124 is preferably a four-bar linkage connected to the same stationary mounting arm 126 with the rearmost-linkage assembly 122. The foremost-linkage assembly 124 has at least four bodies connected in a closed chain, including a section 148 of the mounting arm 126, the mid-panel connecting member 150, the drawing member 152, and a crank member 154. The middle panel 106 is configured to pivot with respect to the mounting arm 126 at pivot point 150*a* through its connection with the mid-panel connecting member 150. The rotation is guided by the crank member 154, the drawing member 152, and the connecting arm 128.

The connecting arm 128 pivotally connects between the foremost-linkage assembly 124 and the rearmost-linkage assembly 122 to coordinate the unfolding and folding of both linkage assemblies 122, 124. Specifically, the rearmost portion of the mid-panel connecting member 150 pivotally connects to the forward-most portion of the stationary mounting arm 126 at the pivot point 150*a*; the middle portion of the mid-panel connecting member 150 pivotally connects to the top portion of the drawing member 152 at hinge 152*a*; and the foremost portion of the mid-panel connecting member 150 pivotally connects to the foremost portion of the connecting arm 128 at hinge 128*b*. The drawing member 152 connects at its top portion to the mid-panel connecting member 150 at hinge 152*a* and at its lower portion to the crank member 154 at hinge 154*a*. The crank member 154 pivotally connects to a first region of the mounting arm 126 at hinge 154*b*. The crank member 154 additionally connects to a second region of the mounting arm 126 at anchor point 155 via the bias member 136. The bias member 136 is preferably an extension spring. Of course, multiple extension springs may operate as a group to compose the bias member 136. The crank member 154 preferably includes a pivotally mounted extending member 156 to connect to the bias member 136, which is secured to a pin 136*a* extending from the extending member 156. The bias member 136 then connects at an anchor point 155 at the rear portion of the mounting arm 126. The extending member 156 pivotally connects to the crank member 154 at hinge 156*a* and is constrained in rotation by slot 156*b*.

During folding, as the mid-panel connecting member 150 rotates at the hinge 150*a*, the pivot point at hinge 152*a* is initially displaced up, during the initial lift of the middle panel 106, and then is displaced downward and backward toward the rearmost-linkage assembly 122 (see dotted arrows at 152*a*), shifting with it the drawing member 152 and the crank member 154. The crank member 154 pivots at hinge 154*b* to displace the hinge 154*a* backward (see dotted arrow at 154*a*), and the pivot point at hinge 156*a* downward (see dotted arrow at 156*a*). Concurrent with the rotation of the mid-panel connecting member 150, the rear-swinging member 144 is configured to pivotally rotate upward and rearward (see dotted arrow at 144) with the back section of the head-panel connecting member 132. The mid-swinging member 134 pivotally rotates with respect to the stationary mounting arm 126 also rearward (see dotted arrow at 134).

Looking at FIG. 14, the rearmost-linkage assembly 122 is designed to fold in a manner that its longest members are substantially aligned to one another to reduce the size of the apparatus 122 when folded. To this end, when the sofa bed 100 is in a fully folded position, the head panel 108 forms an angle $\theta^1$ (158), with the vertical plane, measuring preferably between about 4° and 15° (±0.5°), even more preferably at about 7° (±0.5°). The mid-swinging member 134 forms an angle $\theta^2$ (160), with the vertical plane, measuring preferably between about 25 and 60° (±0.5°), even more preferably at about 37° (±0.5°). The rear-swinging member 144 and the rearmost end of the mounting arm 126 are roughly parallel to the mid-swinging member 134.

Still looking at FIG. 14, the rear-swinging member 144 is attached to the head panel assembly, comprising the head-panel section and the head-panel connecting member 132, at hinge 144*a*. The location of the hinge 144*a* is at a higher position to the hinge 134*a*, which is the connecting point between the mid-swinging member 134 and the head panel assembly. Hinge 144*b* is the rearmost mounting point of the mounting arm 126 to which the rear-swinging member 144 connects. Hinge 134*b* is the "mid-mounting point" of the mounting arm 126 to which the mid-swinging member 134 connects.

In another aspect of the embodiment of the invention, the folded portions of the sofa bed are configured in a manner that the overall height of the sofa bed 100 can be made within a comfortable range for the average person comparable that of a conventional sofa while also having cushions with comfortable thicknesses. This compactness of the sofa bed 100 may be achieved by (i) substantially reducing the distance between the middle and foot panels 104, 106 and (ii) reducing the distance between the stowed middle-panel section and the floor. In doing so, the height of the non-mattress portions of the sofa bed measures preferably less than three inches, even more preferably at about 2 inches (±0.5 inch).

In one aspect of reducing the height of the non-mattress portions, the apparatus 112 is configured such that components that operate in proximity to the floor are compact. Looking at FIGS. 7-9, the apparatus 112 is configured such that the mounting arm 126 is generally the lowest linkage member of the rearmost-linkage assembly 122. To that end, most of the moving linkage components are not in proximity to the floor. However, in order for the bias member 136 to assist in reducing the force required to descend and ascend the middle and foot panel sections, the foremost-linkage assembly 124 is configured to swing above and below the mounting arm 126. Generally, more force is needed to ascend the middle and foot panel sections, when in the folded configuration, to the deployed configuration. To increase the force provided by the bias member 136 during the ascend, the crank member 154 includes the extending member 156 to extend the bias member 136 more when the sofa bed is in the folded configuration (FIG. 9) than when in the deployed configuration (FIG. 4). Moreover, the crank member 154 and extending member 156 include a slotted-pin hinge assembly 153 that pivotally shifts when the crank member 154 is positioned near the floor. In this manner, the length of the crank member 154 can be made to vary the displacement of the bias member 136 across the range necessary to provide the forces to assist in descending and ascending the panel sections in a balanced and controlled manner while having a moving range that does not contact the floor.

In the folded configuration (FIG. 9) and deployed configuration (FIG. 4), the bias member 136 is typically in an extended state, while being at its least extended state at a cross-over or equilibrium configuration (FIG. 7). To this end, the foremost linkage assembly 124 provides a continuous motion between the deployed and folded configuration. The bias member 136 may be appropriately pre-loaded and/or configured with components of suitable spring constant, including multiple spring members, to achieve a near balance and controlled articulation of the sofa bed 100.

In another aspect of reducing the height of the non-mattress portions, the sofa bed 100 is configured such that the distance between the stowed middle and foot panels 104, 106 measures preferably between about 2.25 and 3 inches (±0.025 inch) in which the panels 104, 106 are each approximately ¾ inch in thickness. Looking at FIG. 3, the foot panel 104 and the middle panel 106 include slots 166*a*, 166*b*, also referred to as a "stowing cavity," for stowing portions of each of the leg assembly 116. The slots (166*a*, 166*b*) are preferably located at the interior region of the panels 104, 106. In the embodiment, the foot panel 104 includes the slot 166*a* for stowing: the foot-panel leg 120, the middle-panel leg 118, and connecting-linkage components of the assembly 116. The middle panel 106 includes the slots 166*b* for stowing the additional connecting-linkage components of the assembly 116. Each of the middle-panel leg 118 and foot-panel leg 120 measures preferably between about 12 and 18 inches, even more preferably at about 14 inches (±0.5 inch).

Figure 15:
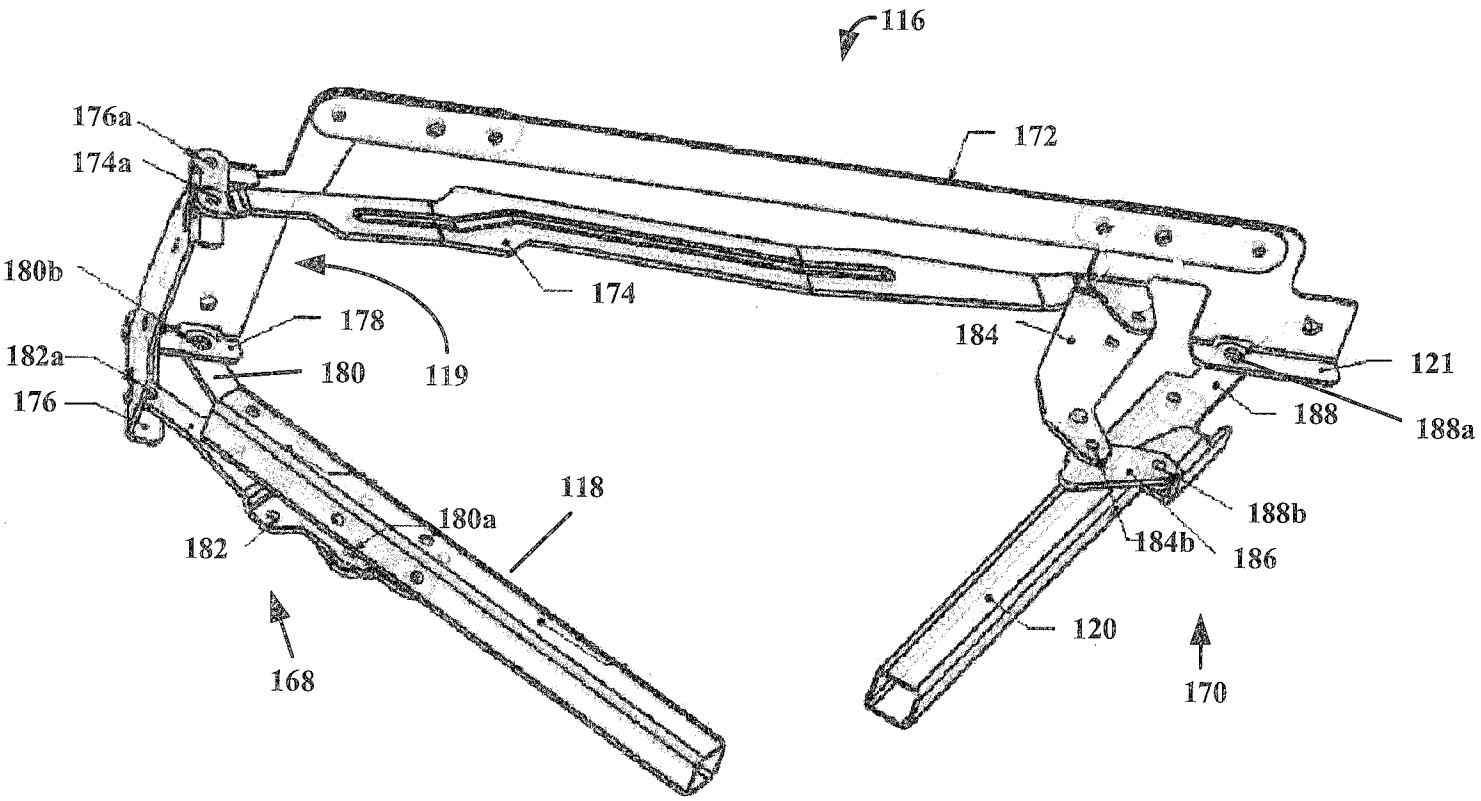
FIG. 15 is a perspective view of a leg assembly within the articulated bed of FIG. 1.
Figure 16:
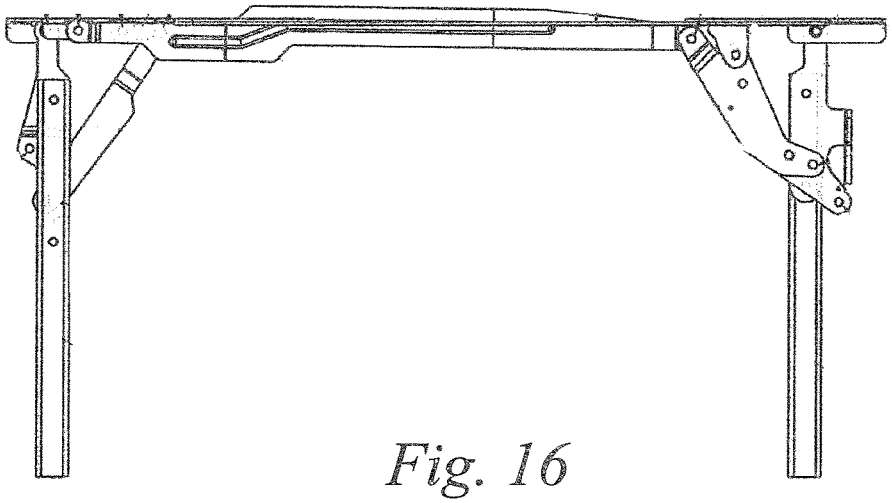
FIGS. 16 and 17 are lateral views of the leg assembly of FIG. 15 in the deployed configuration and during folding.
Figure 17:
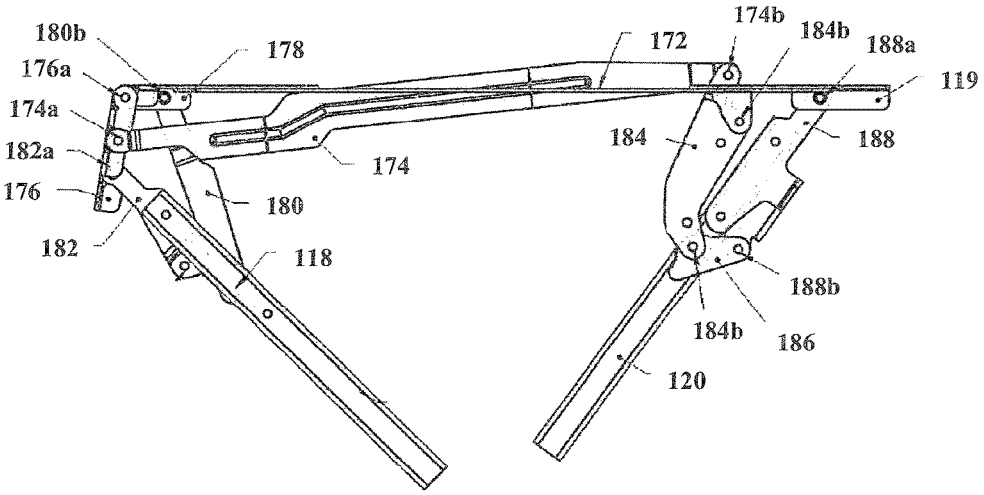

Looking at FIGS. 15-17, an embodiment of the leg assembly 116 is now described. The leg assembly 116 includes a middle-panel-leg sub-assembly 168 and a foot-panel-leg sub-assembly 170 to articulate the middle-panel leg 118 and the foot-panel leg 120, respectively, between a deployed configuration and a folded configuration. A connecting plate 172 links the sub-assemblies 168, 170 together as a module, which may be connected to the panels 104, 106. Such a connecting plate ensures the correct spacing between the leg assemblies so that the correct timing is maintained of one leg folding relative to another. A leg-connecting arm 174 pivotally connects between the middle-panel-leg sub-assembly 168 and a foot-panel-leg sub-assembly 170 to coordinate the articulation between the folded configuration and the deployed configuration.

Specifically, the middle-panel-leg sub-assembly 168 is preferably a four-bar linkage comprising a middle-panel mounting-member 176, a foot-panel mounting-member 178, a cross-bar 180, and the middle-panel leg 118. The foot-panel mounting-member 178 and the middle-panel mounting-member 176 compose the first connecting member 119. The middle-panel mounting-member 176 and the foot-panel mounting-member 178 are L-shaped brackets for mounting to the foot panel 104 and the middle panel 106, respectively. Each of the mounting members 176, 178 has preferably at least two mounting holes. The middle-panel mounting-member 176 is pivotally connected to the foot-panel mounting-member 178 at hinge 176*a*. The middle-panel leg 118 preferably includes a mounting frame 182 to connect to the cross-bar 180 and the middle-panel mounting-member 176. The cross-bar 180 provides provide lateral stability to the middle-panel leg 118. The mounting frame 182 pivotally connects to the middle-panel mounting-member 176 at hinge 182*a* and to the cross-bar 180 at hinge 180*a*. The cross-bar 180 pivotally connects to the foot-panel mounting-member 178 at hinge 180*b*. The leg-connecting arm 174 pivotally connects to the middle-panel mounting-member 176 at hinge 174*a*.

The foot-panel-leg sub-assembly 170 is preferably a four-bar linkage comprising the foot-panel leg 120, the second connecting member 121, a leg crank-member 184, and a leg connecting member 186. The second connecting member 121 is an L-shaped bracket with two angled portions to connect to the leg-connecting arm 174 (see FIG. 17) and the foot-panel leg 120. The foot-panel leg 120 includes a leg frame 188 to pivotally connect to the second connecting member 121 at hinge 188*a*. The leg connecting member 186 connects to the leg frame 188 at hinge 188*b*. The leg-connecting arm 174 pivotally connects to the leg crank-member 184 at hinge 174*b* (see FIG. 17). The leg crank-member 184 provides lateral stability to the foot-panel leg 120. The leg crank-member 184 pivotally connects to the leg-connecting arm 174 at hinge 174*b* and to the leg connecting member 186 at hinge 184*b*.

As the sofa bed 100 folds and the leg assembly 116 begins retracting the legs 118, 120. The timing of the folding of each of the legs 118, 120 has to be adjusted so that the foot-panel leg 120 does not jam against the middle panel 106. In one embodiment, the foot-panel leg 120 folds faster than the middle-panel leg 118. In another embodiment, the middle-panel leg 118 folds faster than the foot-panel leg 120.

Figure 18:
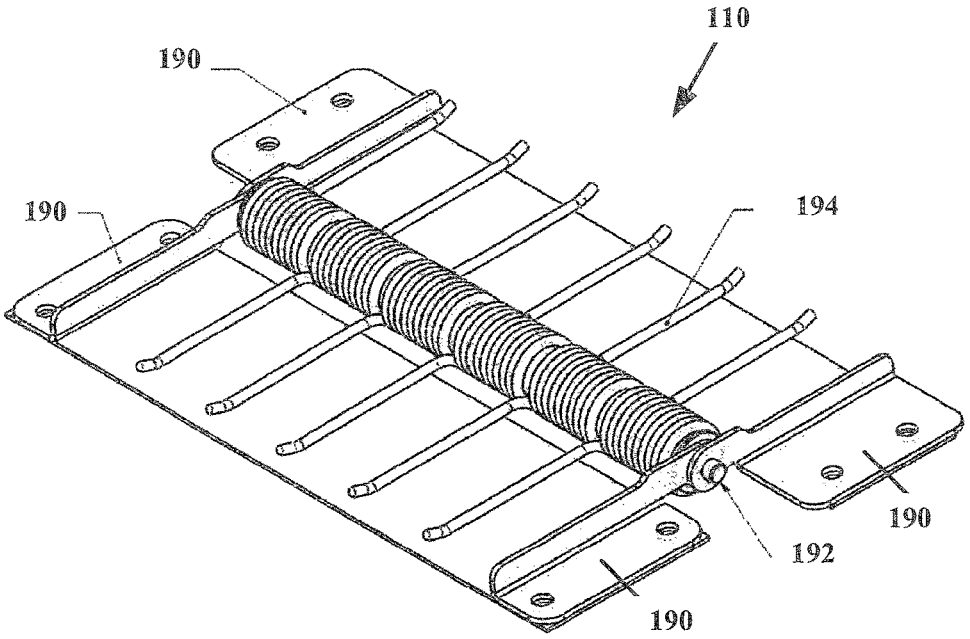
FIG. 18 shows a torsional-hinge assembly in the articulated sofa bed of FIG. 1 in accordance with an embodiment of the invention.

Referring to FIGS. 3 and 18, the foot panel 104 and middle panel 106 are connected in part by the torsional-hinge assemblies 110, also referred to as "torsion units 110," in addition to mounting members 176, 178 of the leg assembly 116. Each of the torsional-hinge assembly 110 includes a pair of brackets 190 held together by a rod 192 which represents a pivot point of the brackets 190. On the rod 192 are also mounted a series of springs 194 which are bias to the position in which the brackets 190 are coplanar. The ends of the springs spread across the width of the brackets 190 to gain leverage. The torsion units 110 assist in the deployment of the sofa bed from its fully folded configuration by applying a force onto both the middle and foot panels 104, 106 to bring them into a coplanar configuration.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A seat convertible to a bed comprising:

a frame with opposed sides;

a bed, located between the opposed sides, having a head panel assembly, a middle panel assembly, and a foot panel assembly, each panel assembly supporting a mattress section; and an apparatus having (i) a rear-swinging member and a mid-swinging member for pivotally attaching to the head panel assembly and the frame and (ii) a front-swinging member for pivotally attaching to the middle panel assembly and the frame, the swinging members controlling the configuration of the head and middle panel assemblies as the bed deploys or retracts between a folded configuration and a deployed configuration, the apparatus including a locking mechanism for fixably maintaining the head panel assembly in a generally horizontal orientation when the bed is in the deployed configuration and releasing the head panel assembly from the deployed configuration by a lifting motion applied to the middle panel assembly, wherein the locking mechanism is connected to the head panel assembly and the mid-swinging member, wherein the locking mechanism is further connected to the head panel assembly and a connecting arm operatively linked to the middle panel assembly, wherein the locking mechanism includes a first linkage member and a second linkage member that pivotally connects to each other, the first linkage member being pivotally connected to the head panel assembly and to the connecting arm, and the second linkage member being pivotally connected to the mid-swinging member.

2. The seat convertible to a bed according to claim 1, wherein the lifting motion moves the connecting arm to push the locking mechanism from a locked position to an unlocked position.

3. The seat convertible to a bed according to claim 1, wherein the first linkage member and the second linkage member form a truss between the head panel assembly and the mid-swinging member when the bed is in the deployed configuration.

4. The seat convertible to a bed according to claim 1, wherein the locking mechanism forms a truss between the head panel assembly and the mid-swinging member when the bed is in the deployed configuration.

5. The seat convertible to a bed according to claim 4, wherein the mid-swinging member constrains the pivoting of the locking mechanism to no further than a locked position when the bed is in the deployed configuration.

6. The seat convertible to a bed according to claim 5, wherein the mid-swinging member includes a locking pin extending therefrom, the locking mechanism having a cam that mates with the locking pin to constrain the pivoting of the locking mechanism.

7. The seat convertible to a bed according to claim 1 further comprising:

bias members located between the middle panel assembly and a foot panel assembly, the bias members biasing the foot panel assembly to separate from the middle panel assembly.

8. The seat convertible to a bed according to claim 1, wherein the rear swinging member is the sofa bed's only pivotally mounted linking member being located behind the head panel assembly in the folded configuration along most of the rear swinging member's length.

9. A seat convertible to a bed comprising:

an apparatus that controls the configuration of a head panel and a second panel of the bed as the bed deploys or retracts between a folded configuration and a deployed configuration, the apparatus including a seat frame with opposed mounting sides having a forward end and a rear end, each of the mounting sides having (i) a forward-linkage assembly at the forward end and (ii) a rear-linkage assembly at the rear end, the forward-linkage assembly being pivotally connected to the second panel, and the rear-linkage assembly being pivotally connected to the head panel, the apparatus including a locking linkage assembly for fixably maintaining the head panel in a generally horizontal orientation when the bed is in the deployed configuration and releasing the head panel from the deployed configuration by a lifting motion applied the second panel, wherein the locking linkage assembly pivotally attaches to the head panel and the rear-linkage assembly and to the head panel and a connecting arm pivotally connected to the forward-linkage assembly, wherein the locking linkage assembly includes two linkages that form a first four-bar linkage with two linkages common with the rear-linkage assembly, wherein the locking linkage assembly forms a truss between a first and a second linkages of the two linkages common with the rear-linkage assembly when the bed is in the deployed configuration.

10. The seat convertible to a bed according to claim 9, wherein the rear-linkage assembly includes four linkages that form a second four-bar linkage.

11. The seat convertible to a bed according to claim 9, wherein the forward-linkage assembly includes four linkages that form a second four-bar linkage.

12. The seat convertible to a bed according to claim 9, wherein the lifting motion moves the connecting arm to push the locking linkage assembly from a locked position to an unlocked position.

13. The seat convertible to a bed according to claim 9, wherein the rear-linkage assembly constrains the pivoting of the locking linkage assembly to no further than a locked position when the bed is in the deployed configuration.

* * * * *